United States Patent [19]

Binder

[11] 4,348,684

[45] Sep. 7, 1982

[54] DEVICE FOR REMOVING EXCESS PIGMENT FROM THE SURFACE OF THE IMAGE CARRIER OF A NON-IMPACT PRINTING MACHINE

[75] Inventor: Jean-Jacques Binder, Valdoie, France

[73] Assignee: Compagnie Internationale pour l'Informatique CII-Honeywell Bull (Societe Anonyme), Paris, France

[21] Appl. No.: 210,312

[22] Filed: Nov. 25, 1980

Related U.S. Application Data

[63] Continuation of Ser. No. 965,412, Dec. 1, 1978, abandoned.

[30] Foreign Application Priority Data

Dec. 12, 1977 [FR] France ..... 77 37289

[51] Int. Cl.[3] ..... G03G 15/00

[52] U.S. Cl. ..... 346/153.1; 15/316 R; 15/345; 355/15; 118/652

[58] Field of Search ..... 346/153, 153.1; 355/15; 15/1.5 R, 1.5 A, 316 R, 405, 345; 118/652, 653, 644, 50, 50.1

[56] References Cited

U.S. PATENT DOCUMENTS

| | | | |
|---|---|---|---|
| 3,624,919 | 12/1971 | Miller | 15/316 |
| 3,983,801 | 10/1976 | Watanabe et al. | 346/153 |
| 4,014,065 | 3/1977 | Hudson | 355/15 |
| 4,026,701 | 5/1977 | Till et al. | 15/345 |
| 4,077,711 | 3/1978 | Akamatso | 355/15 |

FOREIGN PATENT DOCUMENTS

| | | |
|---|---|---|
| 2136634 | 12/1972 | France . |
| 2322395 | 3/1977 | France . |

*Primary Examiner*—Marshall M. Curtis

*Attorney, Agent, or Firm*—Kerkam, Stowell, Kondracki & Clarke

[57] ABSTRACT

A device for removing excess powdered pigment deposited on and adhering to a surface has a chamber provided with air under pressure. The chamber has an orifice with parallel edges extending parallel to the surface with one edge set back from the other edge. The orifice has an opening of from 0.2 mm to 0.02 mm and is spaced from said surface by not more than 1 cm.

7 Claims, 5 Drawing Figures

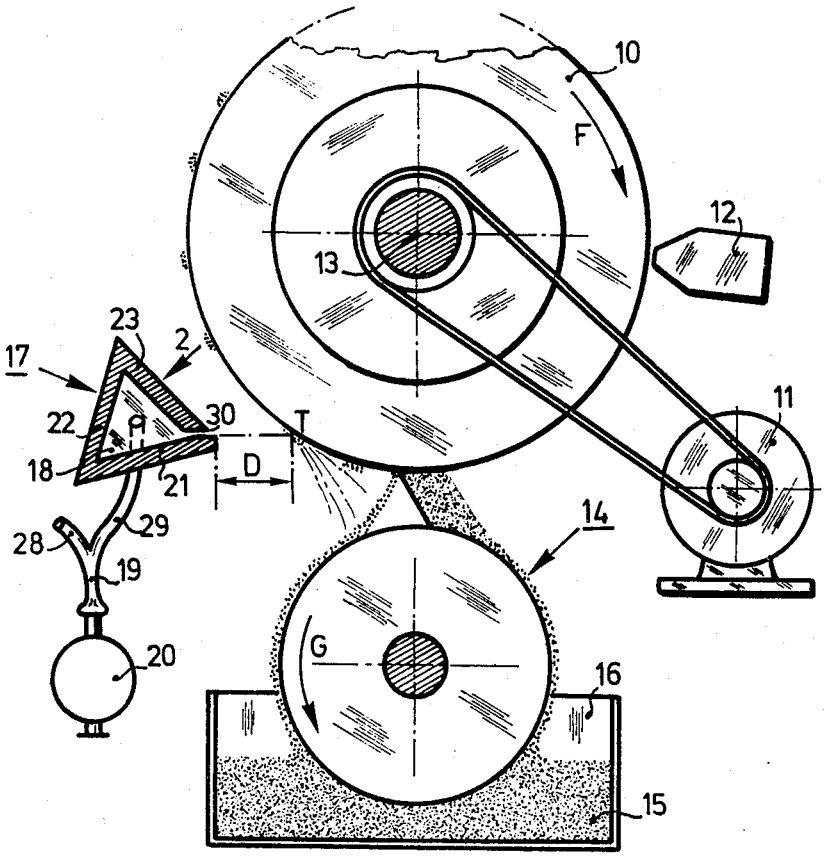
FIG: 1
FIG. 2
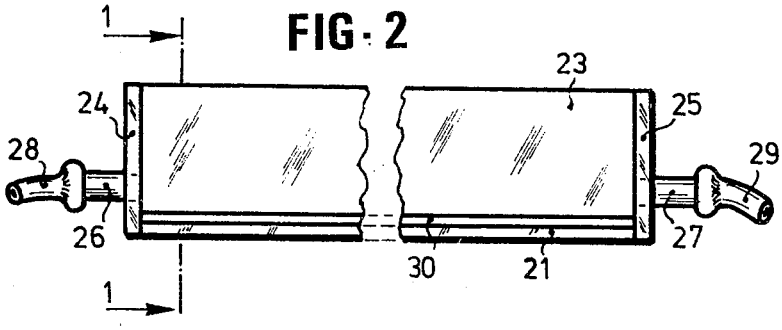

DEVICE FOR REMOVING EXCESS PIGMENT FROM THE SURFACE OF THE IMAGE CARRIER OF A NON-IMPACT PRINTING MACHINE

This application is a continuation of application Ser. No. 965,412, filed 12/1/78, now abandoned.

BACKGROUND OF THE INVENTION

The present invention relates to a device for removing excess pigment from the surface of the image carrier of a non-impact printing machine.

In present day equipment used for data processing, greater and greater use is being made of high-speed printers in which the characters are printed without relying on raised printing characters impacting on a recipient sheet of paper. Such printing machines, which are termed non-impact or again strike-less transfer machines, generally have an image carrier which is usually formed by rotary drum or an endless belt on the surface of which it is possible, by electrostatic or magnetic methods, to form sensitized zones which correspond to the characters to be printed and which are capable of attracting solid particles of pigment. This image carrier is then brought into contact with a recipient sheet of paper to enable the solid particles held by the sensitized zones of the carrier to be transferred to the sheet so that they can be permanently affixed to it.

To apply solid particles of pigment to the image carrier of a printing machine of this kind, use may be made of various applicator arrangements, such, for example, as that which is incidentally described and illustrated in U.S. Pat. No. 3,161,544. However, despite the care which is taken in producing such applicator arrangements, it is very difficult to prevent the particles of pigment from not only depositing in excessive quantities on the sensitized zones of the image carrier but also, even though in very small amounts, from depositing outside these areas. This phenomenon may be attributed to the fact that the particles, when they are charged with moisture or static electricity, or again when they are subject to softening which, even when limited, makes them sticky, adhere to the surface with which they are brought into contact. It is undesirable for excessive quantities of pigment particles to be deposited on the sensitized zones of the image carrier because, when this pigment is transferred to the recipient sheet of paper, there is a danger that the pigment which has been deposited in the configuration of the image formed by these sensitized zones will spread and thus blur the image. In addition, it is also undesirable for pigment particles to be deposited outside the sensitized zones of the image carrier owing to the fact that these particles, when transferred to the paper, form a background which reduces the contrast between the transferred image and the original background formed by the paper.

To remove the excess pigment from the surface of the image carrier, use was made in the prior art of an arrangement in which a mass of pigment particles, which was brought into contact with the surface of the image carrier downstream of the arrangement for applying the particles, removed the charge from the particles which were adhering to the carrier outside the sensitized zones, and the discharged particles then detached themselves from the image carrier and joined up with the mass. Nevertheless, such an arrangement is not entirely satisfactory in use owing to the fact that it does not always insure that the particles are fully discharged and thus does not enable the particles of pigment which are present on the image carrier outside its sensitized zones to be reliably removed. Furthermore, such an arrangement cannot be used to remove excess particles from the image carrier of an electrostatic printer since, when it picks up the electrical charges from the carrier, there is a danger that it will erase the sensitized zones on the carrier.

The present invention overcomes these disadvantages and provides a device which makes it possible effectively to remove excess pigment from the surface of the image carrier of a non-impact printing machine, which machine may be either of the electrostatic or magnetic type.

SUMMARY OF THE INVENTION

This invention relates to a device for removing, from a surface on which a powdered pigment has been deposited, excess particles of pigment which are adhering to this surface, including a chamber which, being connected to a pneumatic pressure device, is provided, opposite the surface, with an orifice which extends in a direction parallel to the surface, the two walls of this chamber which are situated on either side of the orifice having, along the orifice, two mutually parallel outer edges of which one is set back from the other.

BRIEF DESCRIPTION OF THE DRAWINGS

Other objects and advantages of the invention will become apparent from the following description, which is given by way of non-limiting example, and from reference to the accompanying drawings, in which:

FIG. 1 is a schematic partial view of a printing machine fitted with a device constructed in accordance with the invention, FIG. 2 is a view of the device of the invention looking in the direction of arrow 2 of FIG. 1.

DESCRIPTION OF A PREFERRED EMBODIMENT

Figure 3:
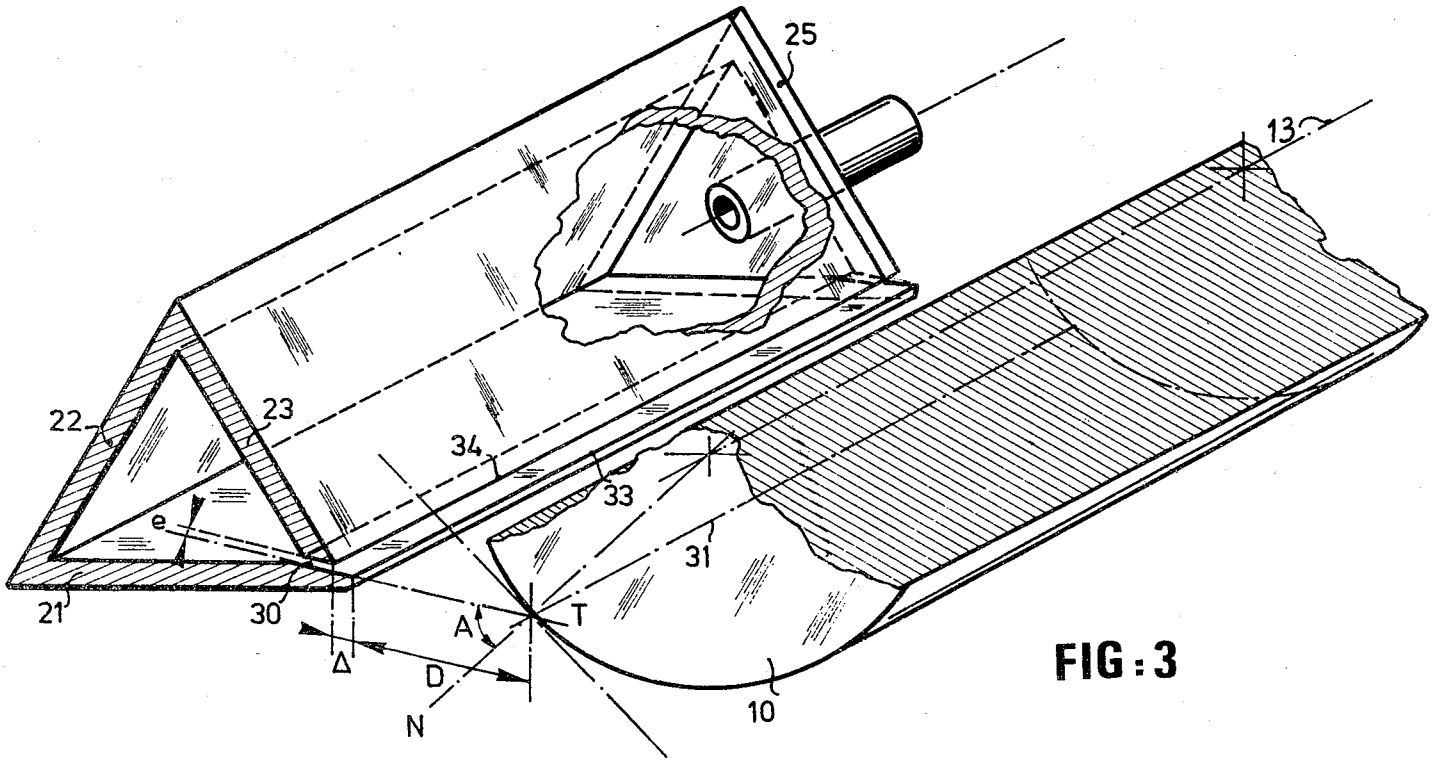
FIG. 3 is a partly cut away perspective view of the device of the invention.

The printing machine of which part is shown schematically in FIG. 1 includes an image carrier which is formed, in the embodiment being described, by a magnetic drum 10, this drum being rotated by an electric motor 11. The direction in which the drum turns is indicated in the figure by an arrow F. The imprinting of information on this drum is performed by a magnetic recording member 12 which is arranged close to the outer surface of the drum. In the embodiment being described, this recording member 12 is formed by an assembly comprising a plurality of magnetic recording heads which, being positioned side by side are aligned parallel to the axis of rotation 13 of the drum. When energized at various times by an electric current, each of the heads generates a varying magnetic field, the effect of which is to create magnetized zones on the surface of the drum as it passes in front of the recording member 12, the times at which the heads are energized being determined, in a known fashion, in such a way to produce, on the surface of the drum, magnetized zones whose shapes correspond to those of the characters to be printed. The magnetized zones on the drum then pass in front of an arrangement 14 of a known kind for applying pigment, which enables particles of a powdered pigment 15 contained in a tank 16 to be applied to the surface of the drum. However, the particles of pigment which are applied in this way to the drum 10 adhere only to its magnetized zones, so that the pigment which remains on the drum after application will form images of the characters which are to be printed. The printing of the characters takes place when, at a later stage, the pigment is transferred by pressure to a print carrier such as a sheet of paper. It should be mentioned here that, in the embodiment described, the pigment is formed by magnetic particles coated with a resin which, when heated, is capable of melting and attaching itself to the paper to which it has been transferred. The nature of the pigment is not however a limitation of the invention. In fact, if the printing machine were of the electrostatic type, the pigment could very well be formed by a powder which contained no magnetic particles. Similarly, to apply the pigment to the drum 10, use could be made of any conventional applicator arrangement. However, in a particularly advantageous embodiment, the applicator arrangement 14 which is shown in FIG. 1 is of the kind which is described and illustrated in patent application Ser. No. 210,312 (Cii/HB Case 2121 corresponding to French application No. 77 31966) which was filed on Oct. 17, 1978 and which is assigned to the assignee of the present invention.

As can be seen in FIG. 1 drum 10, after having passed in front of arrangement 14 for applying the pigment, passes in front of a device 17 whose function is to remove the excess pigment from the surface of the drum, an excess of particles being present both in the sensitized zones and in the unsensitized zones of this surface. In the embodiment which is illustrated in FIGS. 1 and 2, this removal device 17 is formed by a chamber 18 which communicates, by means of a flexible pipe 19, which a pneumatic pressure device 20 of a known kind. In the embodiment being described it is assumed that this pneumatic device is formed by an air compressor of the rotary type which, when rotated, feeds air to the chamber 18 through the flexible pipe 19. If FIGS. 1, 2 and 3 are referred to, it can be seen that the chamber 18, which extends parallel to the shaft 13 on which the drum rotates, is formed by three longitudinal plates 21, 22, and 23 of rectangular shape which are fixed perpendicular to the edges of two transverse plates 24 and 25 of triangular shape, to form an enclosure substantially in the form of a straight, triangular based prism. Transverse plates 24 and 25 have respectively, two ducts 26 and 27 passing through them, which ducts open into the chamber, and are connected to device 20. For this purpose, flexible pipe 19 is divided, as shown in FIG. 1, into two branches 28 and 29 whose ends are attached to ducts 26 and 27 respectively (FIG. 2). FIGS. 1, 2 and 3 also show that longitudinal plates 21 and 23 are not in contact with one another but are spaced a relatively small distance apart to form an orifice 30 through which the air can bescape which pneumatic device 20 pumps into chamber 18.

As can be seen in FIG. 3, orifice 30, which faces drum 10, extends in a direction parallel to the surface of the drum, that is to say parallel to the axis of rotation 13 of the drum. The width of the orifice 30 must be fixed and must lie between two predetermined limiting values. One of these limiting values is a lower limiting value below which the amount of air which leaves through orifice 30 varies considerably from one point to another along the orifice. The other limiting value is that above which the throughput of air would be too great. In the embodiment being described, it has been found that these upper and lower limiting values are equal to 0.2 mm and 0.02 mm respectively.

The edges of plates 21 and 23 which adjoin orifice 30 are machined, in a manner which will be described below, in such a way that there is no divergence in the flow of air which emerges from orifice 30. Under these conditions, the air which escapes from chamber 13 through orifice 30 forms a very shallow jet of air which strikes against the surface of the drum substantially along a line which, being indicated by reference numeral 31 in FIG. 3, is parallel to the axis of rotation 13 of the drum.

Chamber 18 is provided with positioning means of a known kind (not shown) which enable the chamber to be positioned in relation to drum 10 in such a way that the jet of air forms, with a normal N (FIG. 3) to the surface of the drum (this normal being taken at the point T where the jet meets the surface), an angle A whose size is at least equal to a predetermined limiting value which, in the present embodiment, has been found to be 30°. Also, the position of chamber 18 in relation to drum 10 is such that the distance D which the jet of air travels between orifice 30 and the drum is at most equal to 1 cm.

Figure 4:
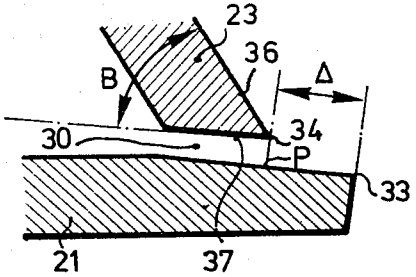
FIG. 4 is a detailed view of part of the device shown in FIG. 3.

With reference to FIG. 4, it can be seen that plates 21 and 23 have two outer edges on either side of orifice 30, the outer edge of plate 21 being shown at 33 and that of plate 23 being shown at 34. These outer edges 33 and 34, which are mutually parallel as can be seen in FIG. 3, are not positioned in line with one another but one of them, i.e., outer edge 34 in FIG. 4, is set back from the other. In other words, plate 21 extends in the direction of drum 10 beyond a point P (FIG. 4) on a perpendicular to outer edge 34. As can be seen in FIG. 3, the portion of plate 21 which extends beyond edge 34 is of a width Δ of relatively small value. Width Δ must not however be less than a predetermined limiting value, which, in the embodiment being described, has been found to be equal to 1 mm. It can also be seen, in FIGS. 3 and 4, that plate 23 is machined in such a way that its outer edge 34 is a sharp edge, whereby the angle B which is formed by faces 36 and 37 of plate 23 which diverge from edge 34 is of a value at most equal to 60°. It has been found that, when the plates 21 and 23 are so machined, the jet of air which is obtained at the exit from orifice 30 shows virtually no divergence and its exit velocity remains substantially constant for the whole length of the orifice. Pneumatic device 20 is designed to produce in the chamber 18 an air pressure such that the velocity at which the air leaves through orifice 30 is on the order of about 30 meters per second. Chamber 18 may be maintained at an air pressure to obtain the desired velocity.

Figure 5:
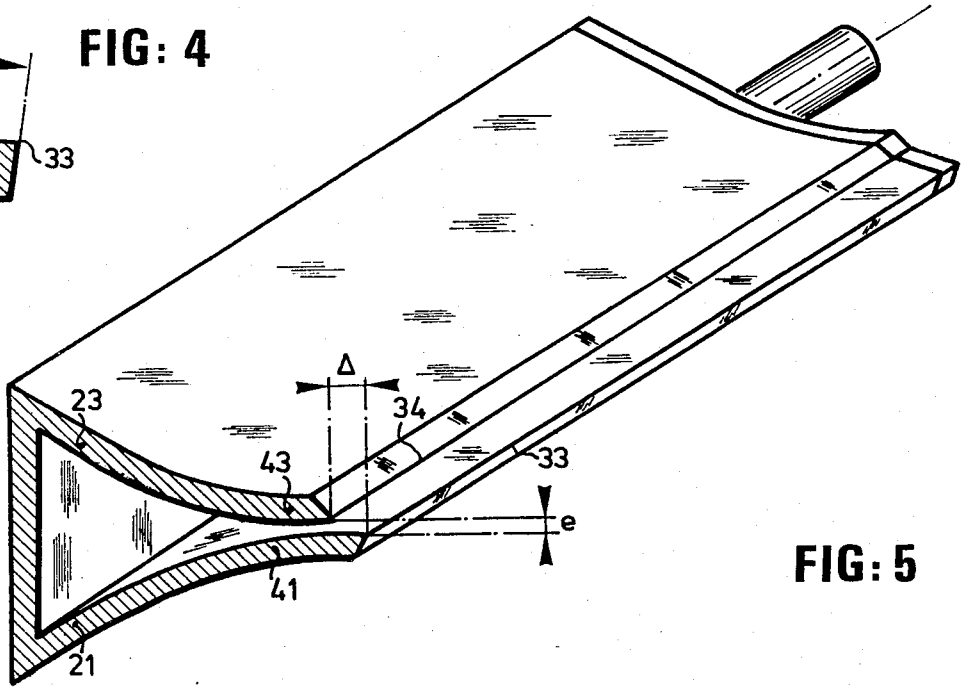
FIG. 5 shows a modified embodiment of the device of the invention as illustrated in FIG. 3.

In the embodiment which is illustrated in FIGS. 1 and 3, plates 21 and 23 on either side of orifice 30 are plane and are inclined to one another, the angle formed between these plates being, in the embodiment illustrated, about 60°. Plates 21 and 23 may have a form different from that shown in FIGS. 1 and 3, provided that they have the characteristics which are mentioned above. Thus, the plates could, for example, be shaped in the manner shown in FIG. 5. In the embodiment illustrated by FIG. 5, plates 21 and 23 are no longer plane but are concave, so that their respective terminal portions 41 and 43 which adjoin orifice 30 are parallel with one another with the distance, which separates these terminal portions 41 and 43, being between 0.2 and 0.02 mm. The terminal portion 41 of plate 21 is bevelled to form a sharp outer edge 34. This edge is set back from the outer edge 33 of plate 23 and the distance Δ, which separates edge 33 from a point situated on a perpendicular to edge 34, being at least equal to 1 mm.

Other modificatins may of course be made to the embodiments of the device for removing excess pigment which have just been described. Thus, chamber 18 could, for example, be of a shape different from that shown in the drawings, provided that the walls of the chamber which are situated on either side of the orifice have the characteristics described above adjacent the orifice. Similarly, baffles, permeable walls or any other means could be arranged inside chamber 18 to obtain an air pressure which has virtually no variation from one point to another within the chamber, which would enable the variations in the velocity of the air to be reduced still further along the length of the orifice 30.

A pigment removal device produced in accordance with the present invention may be used in any non-impact printing machine, whether of the electrostatic, magnetic or similar kind, and, being relatively small in size, may easily be arranged at any suitable point close to the image carrier of the machine no matter the form of the image carrier, whether it is a drum, an endless belt, or some other device.

The invention is not, of course, in any way restricted to the embodiments described and illustrated above, which are described by way of example. Reference should therefore be had to the appended claims to determine the scope of this invention.

What I claim is:

1. A device for removing excess particles of pigment from a surface on which a powdered pigment has been deposited and adhered, comprising:

a pneumatic pressure device for establishing a positive air pressure, and a chamber having at least an entrance orifice connected to said pressure device, and an exit orifice disposed opposite the said surface and extending in a direction parallel to said surface, said exit orifice having a width between 0.2 mm and 0.02 mm, said chamber comprising two plates disposed on either side of and forming said exit orifice, said plates being inclined to one another and terminated by two mutually parallel edges along said exit orifice, one of said edges being set back from the other edge by a distance at least equal to 1 mm, said device being disposed relative to said surface so that the path followed by the gas emerging from the exit orifice of said chamber forms, with a normal to said surface at the point where said path strikes that surface, an angle at least equal to 30°.

2. A device according to claim 1, wherein the one edge which is set back from the other edge is a sharp edge.

3. A device for removing excess particles of pigment from a surface on which a powdered pigment has been deposited and adhered, comprising:

a pneumatic pressure device for establishing a positive air pressure and a chamber having at least an entrance orifice connected to said pressure device, and an exit orifice disposed opposite the said surface and extending in a direction parallel to said surface, said exit orifice having a width between 0.2 mm and 0.02 mm, said chamber comprising a first and a second plate disposed on either side of and forming said exit orifice, said plates being inclined to one another and terminated by two mutually parallel edges along said exit orifice, said edge of the first plate being set back from said edge of the second plate and separated from the latter edge by a distance at least equal to 1 mm, said edge of the first plate being shaped so that its angle is at most equal to 60°, said device being disposed relative to said surface so that the path followed by the gas emerging from the exit orifice of said chamber forms, with a normal to said surface at the point where said path strikes that surface, an angle at least equal to 30°.

4. A device according to any one of claims 1 to 3 which is disposed relative to the surface so that the length of the path of the gas emerging from the exit orifice, between said exit orifice and said surface, is at most equal to 1 centimeter.

5. A device for removing excess particles of pigment from a surface on which a powdered pigment has been deposited and adhered, comprising:

a pneumatic pressure device for establishing a positive air pressure, and a chamber having at least an entrance orifice connected to said pressure device, and an exit orifice disposed opposite the said surface and extending in a direction parallel to said surface, said exit orifice having a width between 0.2 mm and 0.02 mm, said chamber comprising a first and a second plate disposed on either side of and forming said exit orifice, said plates being inclined to one another and terminated by two mutually parallel edges along said orifice, said edge of the first plate being set back from said edge of the second plate and separated from the latter edge by a distance at least equal to 1 mm, said edge of the first plate being shaped so that its angle is at most equal to 60°, said pneumatic pressure device being adapted to provide air under pressure in said chamber, so that said air emerges fom said exit orifice at a velocity of the order of 30 meters per second, said device being disposed relative to said surface so that the path followed by the air emerging from the exit orifice of said chamber forms, with a normal to said surface at point where said path strikes that surface, an angle at least equal to 30°, and the length of said path, between said exit orifice and said surface is at most equal to 1 centimeter.

6. A device for removing excess particles of pigment from the surface of a magnetic drum on which a powdered pigment has been deposited and adhered; said drum having a rotation axis, said device comprising:

a pneumatic pressure device for establishing a positive air pressure, and a chamber formed of three longitudinal plates and of two transverse plates mutually mounted to constitute an enclosure substantially in the form of a straight, triangular based prism having three parallel borders extending in a direction parallel to said rotation axis, said chamber having at least an entrance orifice connected to said pressure device, and an exit orifice disposed along one of said parallel borders and having a width between 0.2 mm and 0.02 mm, the two longitudinal plates which are disposed on either side of and which form said exit orifice being terminated by two mutually parallel edges also said exit orifice, one of said edges being set back from the other of said edges and separated from that other edge by a distance at least equal to 1 mm, said chamber being disposed relative to said drum so that its exit orifice is opposite to that drum and the path followed by the air emerging from said exit orifice forms, with a normal to the surface of said drum at the point where said path strikes that surface, an angle at least equal to 30°.

7. A device for removing excess particles of pigment from the surface of a magnetic drum on which a powdered pigment has been deposited and adhered, said drum having a rotatic axis said device comprising:

a pneumatic pressure device for establishing a positive air pressure, and a chamber formed of three longitudinal plates and of two transverse plates mutually mounted to constitute an enclosure substantially in the form of a straight, triangular based prism having three parallel borders extending in a direction parallel to said rotation axis, said chamber having at least an entrance orifice connected to said pressure device, and an exit orifice disposed along one of said parallel borders and having a width between 0.2 mm and 0.02 mm, the two longitudinal plates which are disposed on either side of and which form said exit orifice being terminated by two mutually parallel edges along said exit orifice, one of said edges being set back from the other of said edges and separated from that other edge by a distance at least equal to 1 mm, said one edge being shaped so that its angle is at most equal to 60°, said pneumatic pressure device being adapted to provide air under pressure in said chamber so that said air emerges from said exit orifice at a velocity of the order of 30 meters per second, said chamber being disposed relative to said drum so that its exit orifice is opposite to that drum and the path followed by the air emerging from said exit orifice forms, with a normal to the surface of said drum, at the point where said path strikes that surface, an angle at least equal to 30°, and the lenght of said path, between said exit orifice and said surface, is at most equal to 1 centimeter.

* * * * *